US006273684B1

(12) United States Patent
Jensen et al.

(10) Patent No.: US 6,273,684 B1
(45) Date of Patent: Aug. 14, 2001

(54) CENTRIFUGAL PUMP UNIT

(75) Inventors: Niels Due Jensen, Bjerringbro; Carsten Nórgaard, Randers; Jórgen Schmidt, Hadsund, all of (DK)

(73) Assignee: Grundfos A/S (DK)

( * ) Notice: Subject to any disclaimer, the term of this patent is extended or adjusted under 35 U.S.C. 154(b) by 0 days.

(21) Appl. No.: 09/525,622

(22) Filed: Mar. 14, 2000

(30) Foreign Application Priority Data

Mar. 31, 1999 (DE) ..... 199 14 581

(51) Int. Cl.[7] ..... F04B 49/00
(52) U.S. Cl. ..... 417/43; 417/38
(58) Field of Search ..... 415/47, 219.1, 415/49, 206, 204; 417/38, 363, 423.14, 373; 219/306

(56) References Cited

U.S. PATENT DOCUMENTS

| | | | | |
|---|---|---|---|---|
| 3,582,229 | * | 6/1971 | von Fellenberg | 415/47 |
| 3,819,297 | * | 6/1974 | East | 417/38 |
| 4,213,745 | * | 7/1980 | Roberts | 417/363 |
| 4,549,849 | * | 10/1985 | Nielsen | 415/219.1 |
| 4,818,177 | * | 4/1989 | Grohmann | 415/49 |
| 4,924,069 | * | 5/1990 | Giordani | 219/306 |
| 5,061,157 | * | 10/1991 | Arakawa | 417/423.14 |
| 5,551,837 | * | 9/1996 | Hergt | 415/206 |
| 5,624,245 | * | 4/1997 | DeClerck et al. | 417/373 |
| 5,911,565 | * | 6/1999 | Mann et al. | 417/373 |
| 6,066,506 | * | 5/2000 | Martin et al. | 415/204 |

FOREIGN PATENT DOCUMENTS

| | | | | |
|---|---|---|---|---|
| 3210762-A1 | * | 1/1983 | (DE) | F04D/13/06 |
| 3701562-A1 | * | 9/1987 | (DE) | F04D/13/06 |
| 42 40 512 A1 | | 12/1992 | (DE) . | |
| 62-283384 | | 11/1987 | (JP) . | |
| 10-174648 | * | 6/1998 | (JP) | A47J/27/21 |
| 116491 | * | 1/1999 | (JP) | F04D/13/02 |

* cited by examiner

*Primary Examiner*—Teresa Walberg
*Assistant Examiner*—L Fastovsky
(74) *Attorney, Agent, or Firm*—Jacox, Meckstroth & Jenkins

(57) ABSTRACT

The centrifugal pump unit includes a flow switch arranged within the pump housing in the flow path of a delivery fluid, which essentially consists of an electromagnetic switch device and a two-armed, pivotably mounted lever whose one arm projects into the flow path and whose other arm carries a magnet which is in contact-free active connection with the switch device. The switch device is arranged within a terminal box mounted on the unit housing. The lever is seated within a switch housing which is incorporated in a cartridge-like manner into the pump housing and which is hermetically sealed to the outside and which is arranged neighbouring the terminal box that such it is only in magnetic active connection so that the reed contact located in the terminal box is controlled by the magnet located in the switch housing. In this manner a usual terminal box may be used which does not need to be sealed with respect to the delivery flow.

10 Claims, 5 Drawing Sheets

Fig. I
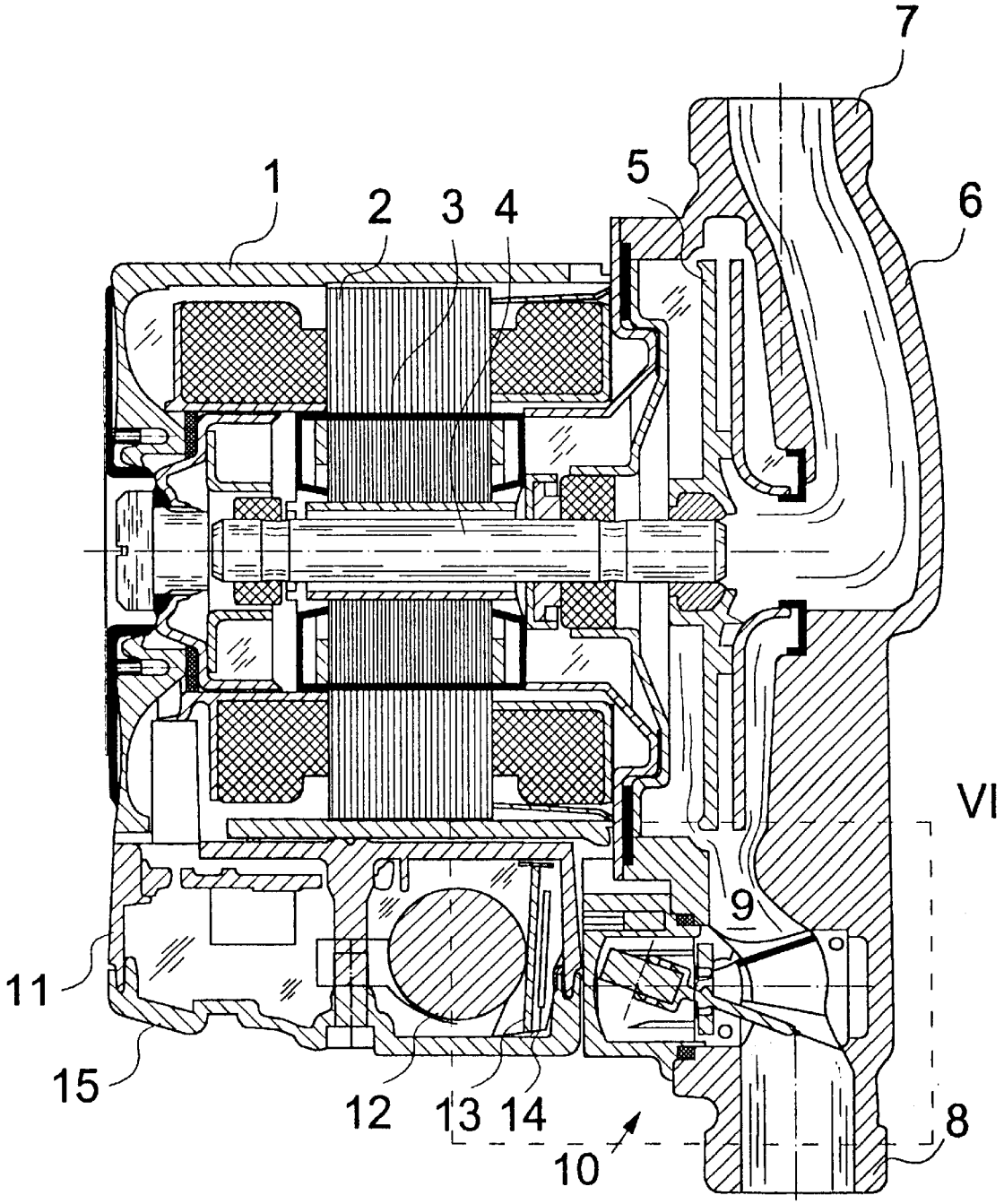

Fig. 3
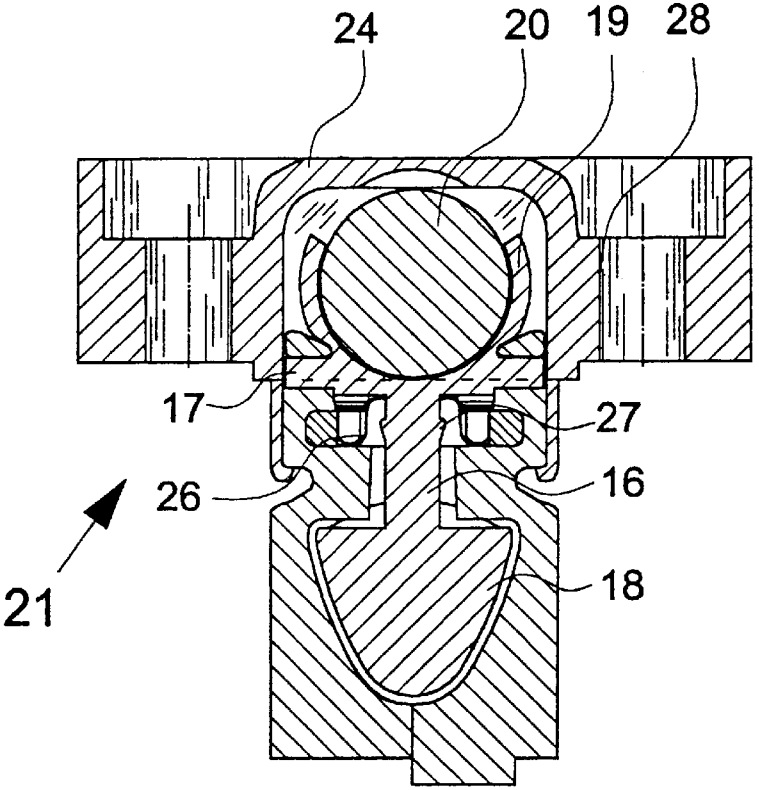
Fig, 2
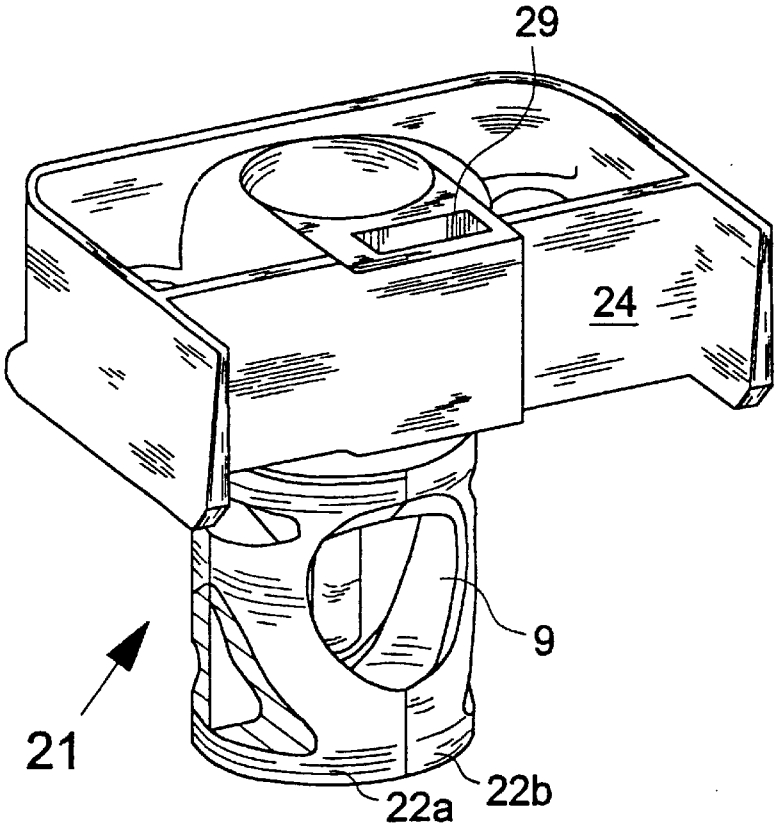

CENTRIFUGAL PUMP UNIT

BACKGROUND OF THE INVENTION

The invention relates to a centrifugal pump unit and more particularly, a centrifugal pump unit comprising an electromagmetic flow switch and a two-armed, pivotally mounted lever.

Centrifugal pump units are used today for increasing the pressure, as so-called booster pumps. In particular, where the central water supply does not constantly have an adequately high operating pressure it is usual to install storage tanks in the roof, wherein then the water is filled from the central water supply up to a certain degree of filling into the storage tank and from here when required flows to the water tapping location in the households located thereunder. By way of this, water may also be tapped when in the central supply conduit the delivery pressure falls or the supply is stopped. Since the static pressure of account of the height difference between the storage tank and the tapping location is mostly only very slight, when electrical or gas-driven water heaters or comparable apparatus which demand a minimum water through-flow are used, it is then necessary to use such booster pumps. Booster pumps are typically used for pressure increases of 0.6 to 0.8 bar with a delivery flow of 0.5 to 1 $m^3/h$.

Since the pressure increase is only required when water is removed, thus when the water heater or a similar apparatus is operated, these pumps are equipped with a flow switch which controls the electric motor of the centrifugal pump unit. When a tap valve is opened at a tapping location and water begins to flow on account of the low present static pressure, this flow switch is stimulated which thereupon switches on the motor of the centrifugal pump unit in order in this manner to produce the desired pressure increase.

Such centrifugal pump units belong to the state of the art. A known such unit is specially designed for this application purpose and comprises a terminal box which covers the motor housing up to the pump housing and here comprises an electromagnetic switch device which is in active connection with a two-armed, pivotably mounted lever arranged in this region in the flow path. This lever with one arm projects in the flow path and on the other arm carries a magnet which controls the switch device in the form of a reed contact.

The disadvantage with this type of construction is the fact that almost all components are usable exclusively for this pump type, in particular that the terminal box with regard to design is adapted to this special centrifugal pump unit.

SUMMARY OF THE INVENTION

Proceeding from this it is the object of the invention to provide a centrifugal pump unit with regard to design such that to a great extent standardised components from mass-produced manufacture may be applied in order to reduce the manufacturing costs.

In one aspect of the invention, this invention comprises a centrifugal pump unit with a flow switch arranged within the pump housing in the flow path of the delivery fluid and essentially consisting of an electromagnetic switch device and a two-armed, pivotally mounted lever whose one arm projects into the flow path and whose other arm carries a magnet which is in contact-free active connection with the switch device, wherein the switch device is arranged within a terminal box mounted on the unit housing, wherein at least the part of the lever carrying the magnet is surrounded by a switch housing which is hermetically sealed to the outside and which is separated from the terminal box and is arranged neighboring this.

The basic concept of the invention is the arrangement of the terminal box spacially and physically from the flow switch in order in this way to be able to apply a terminal box as is also applied for other centrifugal pump units of this size, in particular, heating circulatory pumps. Furthermore by way of the switch housing incorporated into the pump housing in a cartridge-like manner the centrifugal pump unit may be selectively used with or without a flow switch by placing on a suitable sealing cap. The pump unit is thus not only simplified in design, but is also more comprehensive with regard to the application use.

Within the switch housing which to the outside is hermetically closed and is sealed with respect to the pump housing, there is located according to the invention the switch lever which with its one arm projects into the flow path and whose other arm carries a magnet. The magnet thus lies within the switch housing, whilst the switch device as previously remains arranged in the terminal box. The terminal box and switch housing are thus only magnetically actively connected to one another, and are otherwise however spacially and physically completely separated from one another. It is to be understood that the terminal box and the switch housing are to be arranged neighbouring one another in order to ensure the magnetic active connection. Otherwise the terminal box in the known way and manner may be fastened on the motor housing wherein also sealings are to be provided only for the electrical safety, sealings for the delivery medium however are completely done away with. Since the switch housing is hermetically closed towards the outside, thus where, after installation into the pump housing, it is accessible from the outside, a sealing with respect to the pump housing is sufficient in order to ensure a sealing with respect to the delivery flow to the outside. For this a simple ring seal is sufficient if the part of the switch housing projecting into the pump housing is designed cylindrically. Such a cylindrical shape with suitable openings in the region of the flow channel is not only advantageous with regard to the previously mentioned sealing but also simplifies the assembly, since by simple turning any twistings on application may be removed.

Preferably, the switch housing is designed such that the housing part lying outside the pump housing is formed completely closed. In this manner, no sealing arrangements within the switch housing are necessary, the tightness of the arrangement is reliably ensured.

Usefully, the lever pivotably mounted within the switch housing is formed by a one-piece injection moulded part which not only comprises both lever arms, thus the arm projecting in the flow path as well as the arm carrying the magnet, but furthermore, also a pivoting axle with which the lever is mounted within the housing.

In order to guarantee that the lever arm projecting in the flow path is deflected out already with a very low through-flow, it is useful to form this paddle-shaped, thus such that when it lies transverse to the flow it forms a large flow resistance and in the direction of the flow it forms as low a resistance as possible. The outer contour of the paddle-like lever arm should at the same time correspond essentially to the flow channel cross section in order to permit a sensitive as possible reaction.

Although the solution according to the invention permits the lever with the two lever arms to be arranged in the delivery fluid, it is thus not necessary within the switch housing to arrange a seal between the two lever arms—it is however useful to protect, with respect to the switch housing, the lever arm which carries the magnet as well as the pivoting axle by way of an elastic sleeve. In this manner contamination or deposits are prevented from penetrating in this region of the switch housing or flows forming within this housing part are prevented.

Preferably, the lever arrangement is designed such that the flow force acting on the lever reduces with an increasing deflection of the paddle-like lever out of the flow path. On the one hand this may be effected by a suitable shaping of the paddle-like lever arm and on the other hand may be supported by a suitable design of the lever restoring arrangement. The lever restoring is effected preferably also by way of magnet force, wherein for this within or also outside the switch housing a further magnet (auxiliary magnet) may be provided, which according to the arrangement acts in a repelling or attracting manner. Usefully the auxiliary magnet with regard to the magnet arranged on the lever arm is polarised such that it acts repellingly to this. This arrangement is particularly very favorable because it permits the pump housing to be selectively manufactured of plastic or also of a ferromagnetic material without there existing the danger that the lever on account of the magnet force is detained near the pump housing wall.

As previously explained with the formation of the terminal box and the switch housing according to the invention terminal boxes may be applied as are already inexpensively manufactured for heating circulatory pumps in large batches, wherein merely the circuit board arranged within the terminal box is to be correspondingly modified in order to accommodate the reed relay at a suitable location. Such terminal boxes known from heating circulatory pumps usually comprise a three-step switch which with heating circulatory pumps serve for setting the rotational speed. It is therefore particularly advantageous to use this switch which is present anyway, for the pump unit according to the invention, which is effected in that this step switch is given with the switch functions ON, OFF as well as flow switch control. Thus further serial parts may be used for the special application purpose.

Other objects and advantages of the invention will be apparent from the following description, the accompanying drawings and the appended claims.

BRIEF DESCRIPTION OF THE DRAWINGS

The invention is hereinafter described in more detail by way of an embodiment example shown in the drawing. There are shown:

FIG. 1 a longitudinal section through a centrifugal pump unit according to the invention, FIG. 2 the switch housing in an enlarged perspective representation, FIG. 3 a longitudinal section through the switch housing, FIG. 4 the switch housing in a representation according to FIG. 2 with an outer housing sectioned in half as well as a halved insert part, FIG. 5 a longitudinal section through the switch housing in a section plane displaced by 90° to FIG. 3, FIG. 6 the detail VI in FIG. 1 in an enlarged representation, FIG. 7 the detail according to FIG. 6 in an initial position with a representation of the magnetic field coming from the main magnet, and FIG. 8 the representation according to FIG. 7 in a deflected position of the paddle-like lever arm.

DETAILED DESCRIPTION OF THE INVENTION

Figure 5:
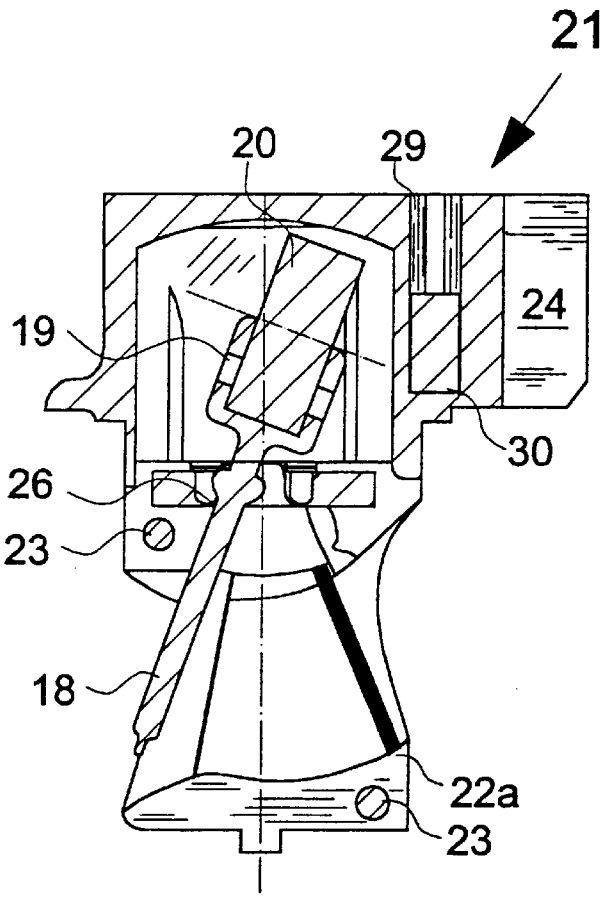
Figure 4:
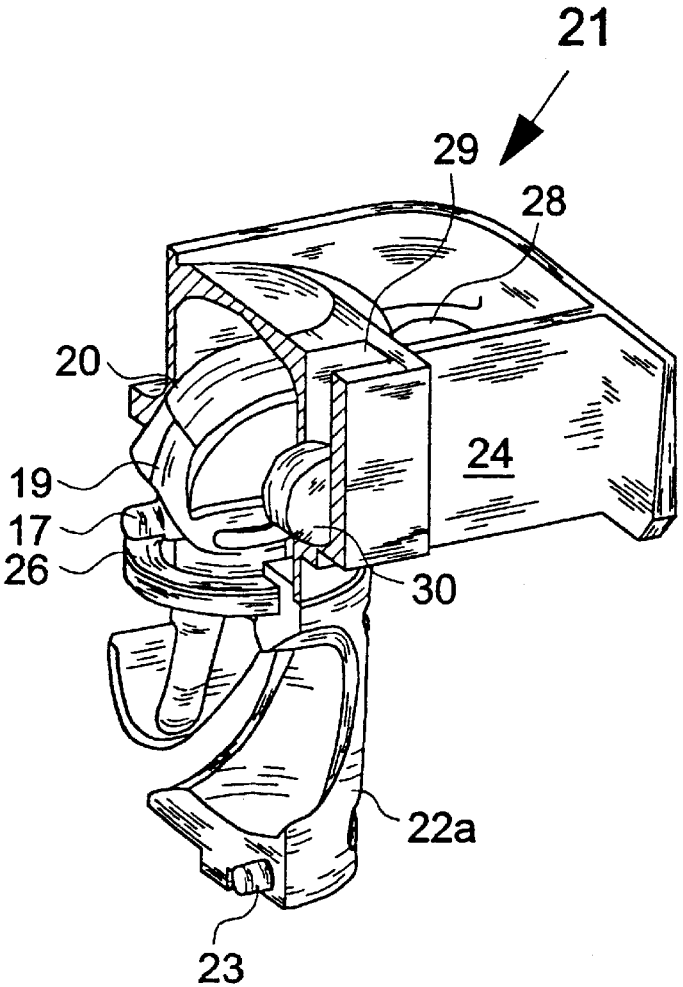

The centrifugal pump unit represented by way of FIG. 1 comprises a motor housing 1 which accommodates an electric motor, with a stator 2 and with a rotor 3 which in a manner known per se is separated from the stator space via a can of the motor. The rotor comprises a shaft 4 which carries an impeller 5 which is arranged within a pump housing 6.

The pump housing 6 is screwed to the motor housing 1 and comprises a suction connection 7 whose channel opens into the suction mouth of the impeller 5. As is usual with spiral housings of this type radial to the impeller 5 there connects a channel 9 leading to a pressure connection 8. In the region of this channel 9, there is arranged a flow switch 10.

Laterally on the motor housing 1 there is arranged a terminal box 11 in which the electrical wiring between the stationary mains supply and the motor and in which furthermore the complete electronics of the unit are arranged. In the representation according to FIG. 1 from these components there is recognisable a capacitor 12, a circuit board 13 as well as a reed relay 14 arranged between the circuit board 13 and the housing wall. The terminal box 11 is closed by a removable lid 15.

Figure 6:
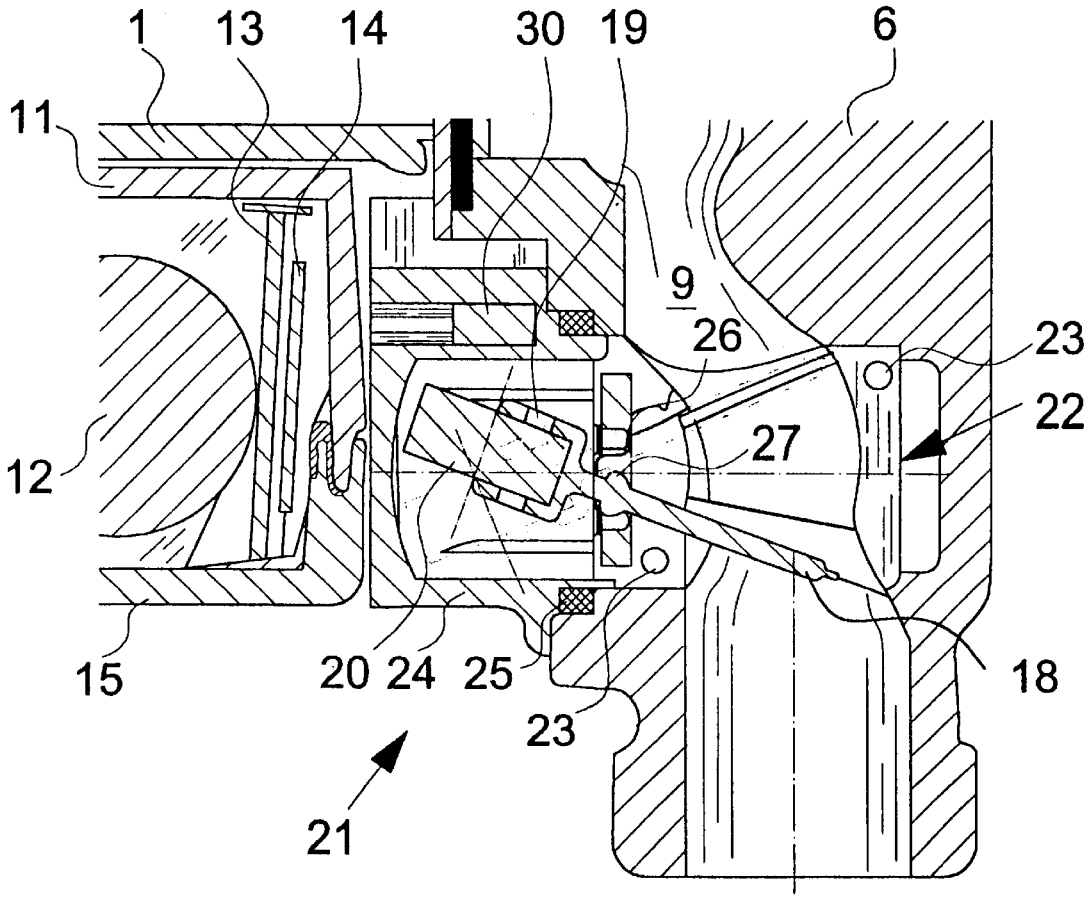
Figure 7:
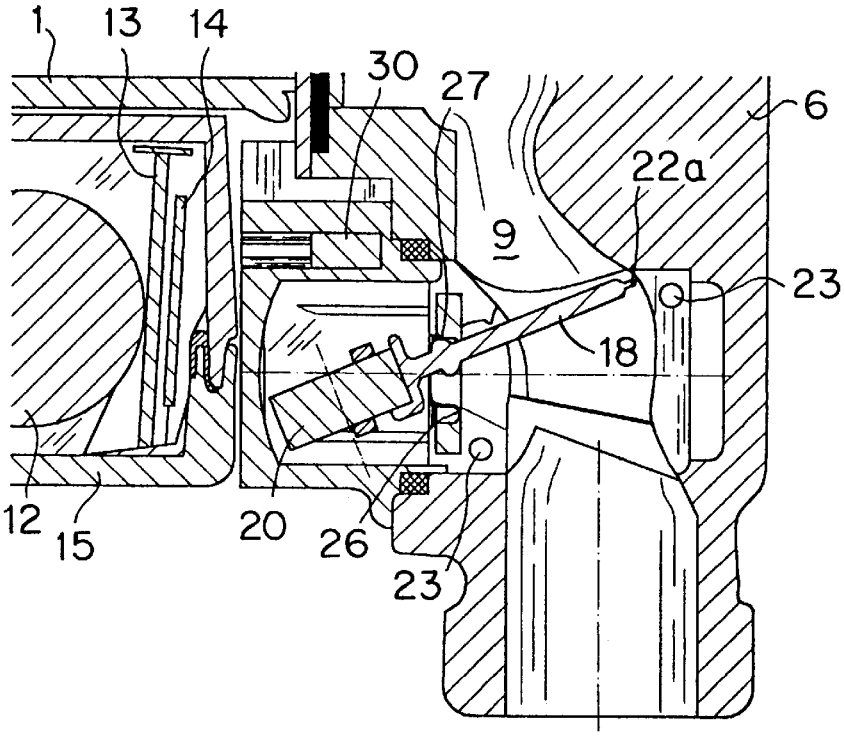
Figure 8:
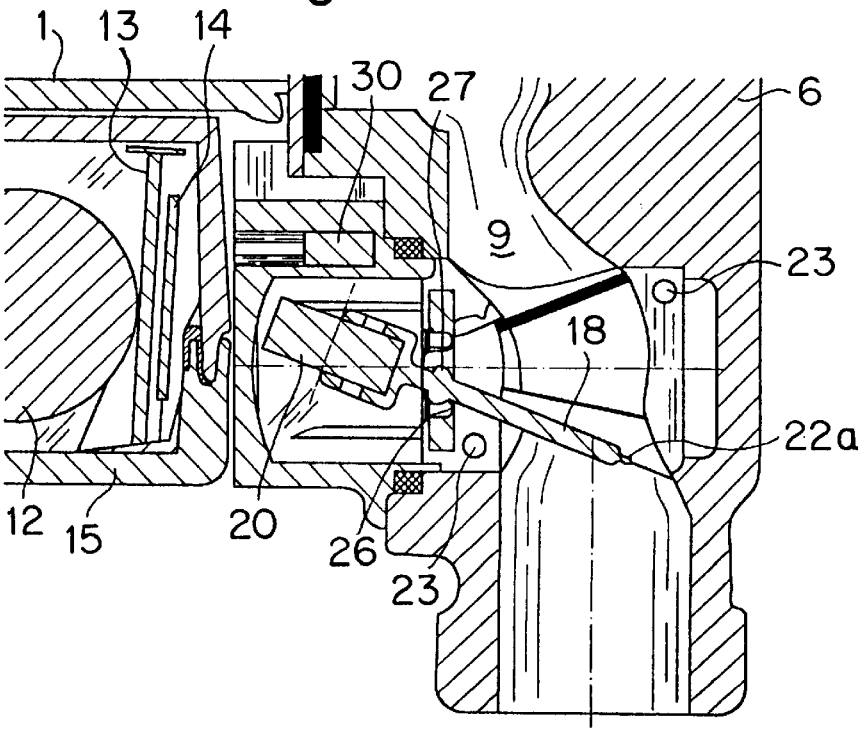

The flow switch 10 comprises a lever 16 (FIG. 3) formed as an injection moulded part, a pivoting axle 17, a lever arm 18 projecting into the channel 9 as well as a lever arm 19 projecting to the other side. The lever arm 18 is designed paddle-like as can be clearly recognised in FIG. 3. Its outer contour is adapted to the channel cross section in this region so that it in the idle position almost completely closes the channel 9 (as shown in phantom in FIG. 6). The lever arm 19 (FIG. 3) arranged at the other side of the pivoting axle 17 is formed as a mounting for a magnet 20 fastened thereto. The magnet 20 has a cylindrical shape and a north-south polarisation along the cylinder axis so that the one end-face side forms the north pole and the other end-face side the south pole, as also the magnetic field lines drawn in the FIGS. 7 and 8 make clear.

The magnet 20 cooperates with the reed relays 14 arranged in the terminal box 11 so that according to the position of the lever 16 or of the magnet 20 the reed relay is located in the one or the other switch position. The two switch positions are represented in the FIGS. 7 and 8. With this the switching is effected in a manner that in the idle position (FIG. 7), thus when no flow is effected within the channel 9, the motor is switched off and in the other deflected out position (FIG. 8) the motor is switched on.

The lever 16 (FIGS. 3–6) is mounted within a switch housing 21 which is formed in three parts. It comprises a cartridge-like insert part 22 which has an essentially cylindrical outer contour and is formed of two plastic injection moulded parts 22*a* and 22*b*. The insert part 22 comprises an opening transverse to the insert direction, which continues the channel 9. The insert part halves 22*a* and 22*b* are joined together by way of fixing pins 23 with the incorporation of the lever 16. In the installation location, the halves are held in the pump housing 6 by the correspondingly cylindrically shaped transverse bore to the channel 9. Furthermore, an outer housing 24 consisting of a plastic injection mould laps over a cylindrical shoulder of the insert part 22. Since the switch housing 21 not only has delivery fluid contact in the region of the paddle-like lever arm 18, but also the inner space of the outer housing may be filled with fluid, it only requires a ring seal 25 with which the outer housing 24 is sealed with respect to the transverse bore in the pump housing 6.

In order to prevent dirt deposits or likewise from getting into the inside of the outer housing 24 there is provided an elastic protective sleeve 26 which on one side is seated on the lever 16 and on the other side is held within the insert part 22. For assembly, the protective sleeve is firstly pushed so far over the lever 16 until it assumes its directed position roughly in the middle (see FIG. 3). It may not slip from this position on account of a projection 27 on the lever. The sleeve edge is then fixed in the insert part 22, wherein then the whole insert part with the lever located thereon is introduced into the outer housing 24 in order then to be accommodated in the transverse bore of the pump housing 26 and to be fixed by screw by way of the bores 28 provided on the outer housing.

Within the outer housing 24 there is formed a recess 29 open to the outside, which is accessible before assembly and on whose base there is fixed a further magnet 30 (auxiliary magnet). The auxiliary magnet likewise has a cylindrical shape and a north-south polarisation along its cylinder axis. With this the arrangement to the magnet 20 is selected such that on the end-face side equal poles lie opposite one another so that the magnet 20 is repelled by the magnet 30.

The outer housing 24 comprises a cavity which is open towards the channel and which accommodates the lever arm 19, as well as neighbouring, the recess 29 for the magnet, which is accessible from the outside and is otherwise in its shape adapted to the outer contour of the terminal box. The recess 29 is only accessible when the terminal box 12 is removed or the pump housing 6 with the switch housing 21 is removed from the motor housing 1. The distance between the terminal box 11 and the switch housing 21, in particular outer housing 24 is selected such that on the one hand there is formed a free intermediate space, and on the other hand however the magnet 20 reliably switches the reed relay 14.

The function of the previously described arrangement is as follows: In the initial position (FIG. 7) within the channel 9 there flows no fluid. The repelling force of the magnet 30 to the magnet 20 has the effect that the lever 16 is pivoted into the idle position shown in FIG. 7 in which the paddle-like lever arm 18 almost completely closes the flow channel 9. As soon as a valve is opened for the purpose of tapping water, on account of the static pressure, a small quantity of water flows through the pump, which leads to the fact onto the lever arm 18 there is exerted a flow force which moves the lever arm into the pivoted-out position shown in FIG. 8. By way of this the magnet 20 moves with respect to the reed relay 14 which by way of this changes its switch position, switches on the motor and thus further increases the flow through the channel. Only when the tapping is finished and the valve is again closed does the lever 16 fall back again into the initial position shown in FIG. 7 in which the pump is switched off.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A centrifugal pump unit comprising a flow switch arranged within the pump housing in the flow path of the delivery fluid and having of an electromagnetic switch device and a two-armed, pivotably mounted lever whose one arm projects into the flow path and whose other arm carries a magnet which is in contact-free active connection with the switch device, wherein the switch device is arranged within a terminal box mounted on the unit housing, wherein at least the part of the lever carrying the magnet is surrounded by a switch housing which is hermetically sealed to the outside and which is separated from the terminal box and is arranged neighboring this.

2. A centrifugal pump unit according to claim 1, wherein the switch housing comprises a part projecting into the pump housing, which has an essentially cylindrical shape, is interrupted in the region of the flow channel and is incorporated cartridge-like into the pump housing.

3. A centrifugal pump unit according to claim 1, wherein the switch housing comprises a housing part lying outside the pump housing as well as a housing part lying within the pump housing, and wherein only the housing part lying outside the pump housing is sealed with respect to the pump housing.

4. A centrifugal pump unit according to claim 1, wherein the lever arms are formed by a one-piece injection molded part which also comprises an axle arranged between the lever arms, with which the lever is pivotably mounted within the switch housing.

5. A centrifugal pump unit according to claim 1, wherein the lever arm projecting into the flow path is designed paddle-like and in its outer contour is adapted to the flow channel cross section in this region.

6. A centrifugal pump unit according to claim 1, wherein a lever arm is protected with respect to the flow housing by an elastic sleeve arranged near the axle.

7. A centrifugal pump unit according to claim 1, wherein a flow force acting on the lever reduces with an increasing deflection of the paddle-like arm out of the flow path.

8. A centrifugal pump unit according claim 1, wherein a multi-step switch is provided, wherein in one switch step the unit is completely switched on, in another switch step completely switched off and in a third switch step is switched depending on the lever position of the flow switch.

9. A centrifugal pump unit according to claim 1, wherein in the switch housing there is arranged a further magnet for restoring the lever.

10. A centrifugal pump unit according to claim 1, wherein the further magnet is directed repellingly with respect to the magnet arranged on the lever arm.

* * * * *